US005810650A

United States Patent [19]

Jöst

[11] Patent Number: 5,810,650

[45] Date of Patent: Sep. 22, 1998

[54] GRINDING MEMBER AND AN ADAPTER FOR MOUNTING THE GRINDING MEMBER ON A GRINDING MACHINE OR A GRINDING MEMBER HOLDER

[76] Inventor: Peter Jöst, Hardbergstr. 19, D-69518 Abtsteinach, Germany

[21] Appl. No.: 682,251

[22] Filed: Jul. 17, 1996

[30] Foreign Application Priority Data

Dec. 29, 1995 [DE] Germany ..... 295 20 566 U

[51] Int. Cl.[6] ..... B24D 11/02; B24B 55/06

[52] U.S. Cl. ..... 451/527; 451/456; 451/538; 451/539

[58] Field of Search ..... 451/453, 456, 451/527, 533, 534, 538, 539, 548

[56] References Cited

U.S. PATENT DOCUMENTS

| | | | |
|---|---|---|---|
| 2,749,681 | 6/1956 | Reidenbach | 451/527 |
| 2,838,890 | 6/1958 | McIntyre | 451/527 |
| 3,021,649 | 2/1962 | Robbins | 451/534 |
| 3,353,308 | 11/1967 | Zane | 451/539 X |
| 4,062,152 | 12/1977 | Mehrer | 451/456 X |
| 4,287,685 | 9/1981 | Marton | 451/456 X |
| 4,759,155 | 7/1988 | Shaw | 451/456 X |
| 4,839,995 | 6/1989 | Hutchins | 451/456 X |
| 4,905,420 | 3/1990 | Flachenecker et al. | 451/456 X |
| 4,937,984 | 7/1990 | Taranto | 451/456 X |
| 4,964,243 | 10/1990 | Reiter | 451/456 X |
| 4,964,245 | 10/1990 | Braasch | 451/539 X |
| 5,007,206 | 4/1991 | Paterson . | |
| 5,027,470 | 7/1991 | Takashima | 451/456 X |
| 5,036,627 | 8/1991 | Walters . | |
| 5,309,681 | 5/1994 | Cheney et al. | 451/538 X |

FOREIGN PATENT DOCUMENTS

| | | | |
|---|---|---|---|
| 0578865 | 1/1994 | European Pat. Off. . | |
| 1085962 | 2/1955 | France | 451/533 |
| 9607509 | 3/1996 | WIPO . | |
| 9613358 | 5/1996 | WIPO . | |

OTHER PUBLICATIONS

European Search Report J 21 EP Application No. 96106587.7.

*Primary Examiner*—Timothy V. Eley
*Attorney, Agent, or Firm*—Anderson, Kill & Olick, P.C.

[57] ABSTRACT

A grinding member attachable to a grinding disc, an attachment plate of a grinding machine, or a manual holder, and including an abrasive-containing layer, and a perforation substantially uniformly distributed over at least a portion of a surface of the abrasive-containing layer and extending through an entire thickness of the abrasive-containing layer, with the perforation being formed of a plurality of openings so spaced from each other that unhindered suction of abrasive dust is insured; and adapter for attaching the grinding member.

18 Claims, 5 Drawing Sheets

GRINDING MEMBER AND AN ADAPTER FOR MOUNTING THE GRINDING MEMBER ON A GRINDING MACHINE OR A GRINDING MEMBER HOLDER

BACKGROUND OF THE INVENTION

1. Field of the Invention

The present invention relates to a grinding member attachable to a grinding disc, an appropriate support or an attachment place of a grinding machine and having an abrasive-containing layer and an adapter for attaching the grinding member.

2. Description of the Prior Art

Grinding members, in particular, machine-attachable grinding members of different constructions and geometrical shapes are well known.

To achieve perfect results of a grinding operation, a continuous discharge of the abrasive dust during a grinding operation is necessary. In the absence of the abrasive dust discharge or when the discharge is effected only from time to time, the grinding wheel becomes clogged up with the abrasive dust, and single abrasive grains are not any more operable. The result of this is an unsatisfactory quality of the ground surface and a noticeably reduced durability of a grinding wheel.

To provide for continuous discharge of the abrasive dust, the grinding disc or the attachment plate of a grinding machine is provided with suction means, with the grinding member being provided with means which transfer the abrasive dust to the suction channels or the openings provided in the grinding disc or attachment plate. Such suction means is provided for both the grinding machines and manual grinding member holders. The transferring means is usually formed as openings in the grinding member. To insure obtaining of satisfactory results of a grinding operation, an operator should so mount the grinding member on the grinding disc or the attachment plate that the openings in the grinding member coincide with the suction channels formed in the grinding disc or the attachment plate. This task becomes even more complicated when an adapter is located between the grinding member and the grinding disc or the attachment plate. In practice, however, even if the alignment has been effected, it is not a guarantee of a continuous satisfactory removal of the abrasive dust. This is because the abrasive dust is removed not at the locations where it is originated but rather at the locations where it, as a result of the rotation or oscillation of the grinding member, is transported beneath the suction openings. In the meantime, the abrasive dust is deposited on the workpiece and the grinding surface of the grinding member.

Accordingly, an object of the invention is to provide a grinding member and an adapter which would insure a continuous satisfactory removal of the abrasive dust both when the grinding member and the adapter are used together or used separately.

SUMMARY OF THE INVENTION

This and other objects of the invention, which will become apparent hereinafter, are achieved by providing a grinding member having a perforation substantially uniformly distributed over at least a portion of a surface of the abrasive-containing layer and extending through an entire thickness of the abrasive-containing layer, the perforation being formed of a plurality of openings so spaced from each other that, upon the attachment of the grinding member to the one of the grinding disc and the attachment plate, the perforation openings are arranged with respect to the suction means so that an unhindered suction of abrasive dust is insured, and by providing an adapter likewise having a perforation corresponding to the perforation of the grinding member.

Providing such a grinding member and an adapter, which are arranged one above the other, providing for the communication of the openings therebetween and with the suction channels of the grinding disc or the attachment plate, which insures a reliable suction and removal of the abrasive particles together with the exhaust air.

Dependent on the construction of the grinding member, the perforation can be provided only in one, abrasive-containing layer, when the above and/or below located layer, if present, is gas- and particle permeable. With a multi-layer grinding member, the perforation penetrates all of the layers if they are not gas and/or particle permeable. The same applies to the adapter.

It should be pointed out that the grinding member according to the present invention insures a reliable continuous removal of the abrasive dust even in the case when the grinding machine or the manual grinding member holder is not provided with suction means. One skilled in the art would appreciate that due to the presence of the perforation, the abrasive dust would be removed from the grinding surface by the pressure forces and would be transported into areas and layers located beneath the grinding plane. Thus, the clogging of the grinding grains would be substantially prevented.

According to a preferred embodiment of the invention, the grinding member includes a burred connection layer which is likewise pierced with the perforation.

According to the advantageous embodiment of the invention, the grinding member includes an auxiliary layer located between the abrasive-containing and burred connection layers.

The auxiliary layer is formed as an elastic layer, which may also serve as a temperature insulating layer. The auxiliary layer may be used in a wet grinding operation and/or a dry grinding operation. According to the invention, the auxiliary layer is formed of a foam material, which provides communication channels for communicating the perforation openings with the suction means provided in the one of the grinding disc and the attachment plate. At that, both the perforation openings and the communication channels are gas and particle permeable.

According to the invention, the perforation-forming openings can have circular, square, rectangular, polygonal, oval or star-shaped cross-section. The perforation-forming openings can also be formed as rectilinear or arcuate slots. The same applies to the perforation openings of the adapter.

The cross-section of the grinding member and the adapter can likewise be of different shape. The cross-section can be of any desired shape, e.g., circular, polygonal, star-shaped, etc.

The abrasive support can be formed of paper, cloth, wool, etc.

According to the present invention, the adapter can include a burred connection, foam and velvet layers, with the burred connection layer being designed to cooperate with the burred connection layer of the grinding member.

BRIEF DESCRIPTION OF THE DRAWINGS

The features and objects of the present invention will become more apparent, and the invention itself will be best understood from the following detailed description of the preferred embodiments when read with reference to the accompanying drawings, wherein.

DETAILED DESCRIPTION OF THE PREFERRED EMBODIMENTS

Figure 4:
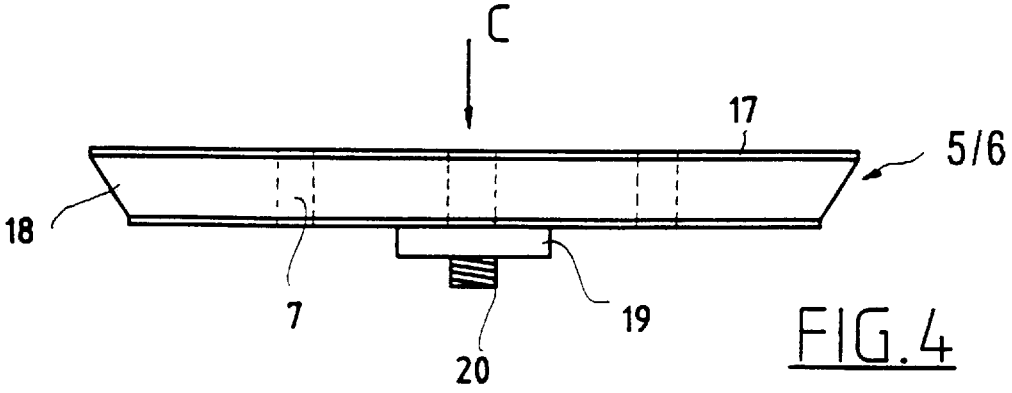
FIG. 4 shows a side view of a grinding disc.
Figure 5:
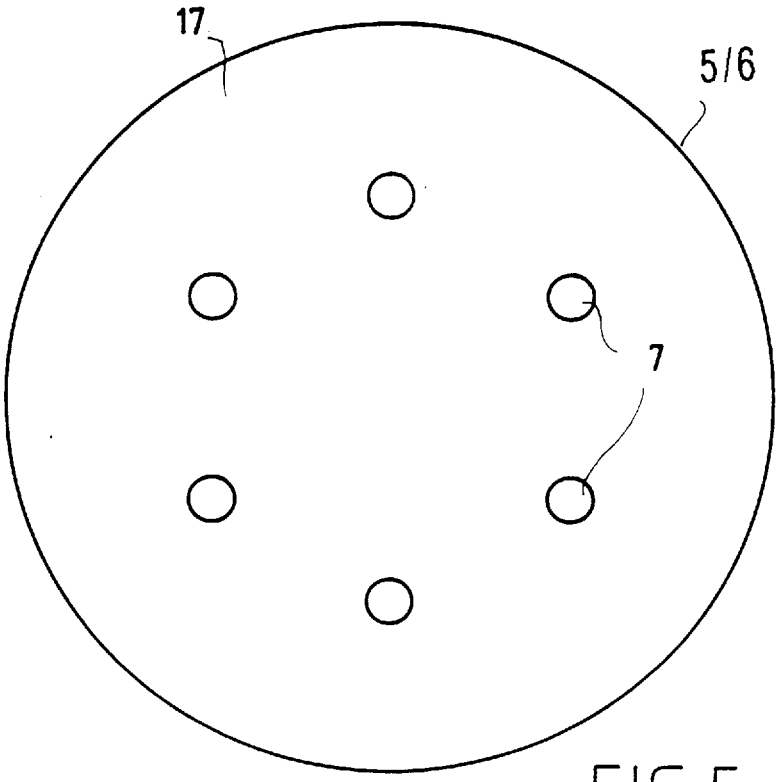
FIG. 5 shows a bottom view of the grinding disc shown in FIG., as seen in the direction of arrow "C"

FIG. 4 and 5 show a grinding disc 5 which is provided with suction bores 7 through which the abrasive dust is removed and subsequently delivered into a collection sack. The suction device for aspirating the abrasive dust is mounted on or in the grinding machine. The grinding disc 5 or a similar grinding member support 6 may or may not be provided with the suction bores.

The present invention involves providing means which insures delivery of the abrasive dust to the suction bores 7 or similar suction means. Conventionally, the grinding member, e.g., a circular grinding disc-shaped element is provided with a plurality of openings which coincide with the bores 7 or the like. As it has already been discussed above, this technology does not insure that satisfactory results of the grinding operation are achieved. The present invention, as discussed above, permits to achieve reliable satisfactory results of a grinding operation by providing both the grinding member and grinding disc 5 with cooperating burred connection surfaces 11 and 17, respectively. The grinding disc 5 is further provided with a pressure and impact compensating soft layer 18. The layer 18, together with a perforation surface, is fixedly attached to a support plate 19 provided with a connection member 20 for attaching the disc 5 to a grinding machine. Both the burred connection layer 17 and the soft layer 18 are pierced with through-bores 7 or the like.

The suction of an abrasive dust is not possible when the opening provided in the grinding member 1, do not coincide with the bores 7, provided in the grinding disc 5 upon mounting of the grinding member 1 on the grinding disc 5 even when the grinding body 1 is properly positioned, a continuous suction of the abrasive dust is not insured.

To insure a continuous suction of the abrasive dust, according to the invention, the grinding member 1 is provided with perforation 8 distributed along the entire surface of the grinding member. The grinding member can be formed of different layers, dependent on a selected grinding process, properties of the ground layer, the material of the ground workpiece . . . According to the present invention, at least the layer 3, which carries the abrasive 2 is provided with openings 9 forming the perforation 8. The perforation 8 and the bores 7 provided respectively in the grinding member 1, and the grinding disc 5 insure an unhindered suction of the abrasive dust. At that, the perforation extends through the entire grinding member. E.g, if the grinding body 1 is formed of a layer 3 carrying the abrasive 2 or an abrasive layer carrying or abrasive-containing layer 10, and a burred connection layer 11, the perforation 8 penetrates through all of the layers.

Figure 1:
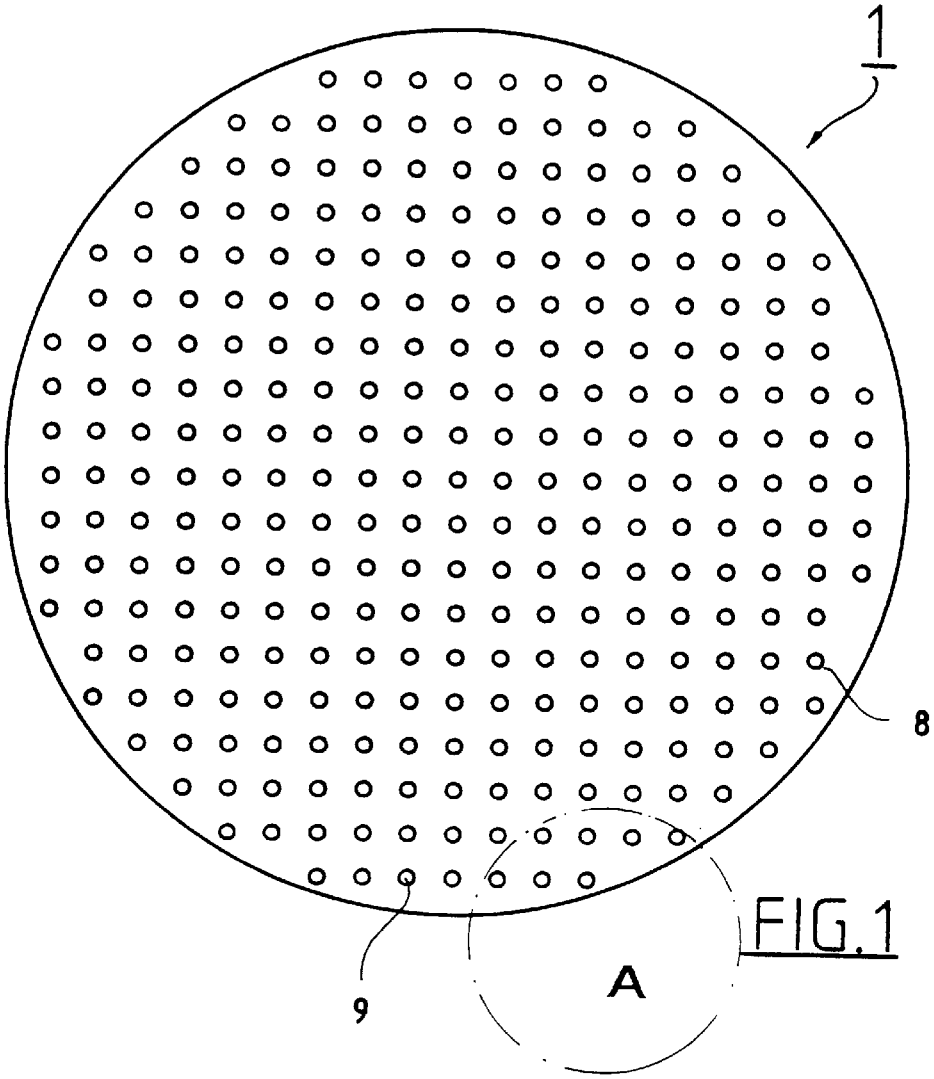
FIG. 1 shows a plan view of a grinding member with a burred connection surface according to the present invention.
Figure 3:
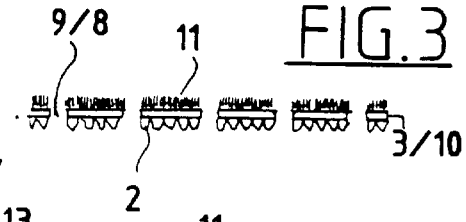
FIG. 3 shows an enlarged cross-sectional view along line 3—3 in FIG. 2.
Figure 2:
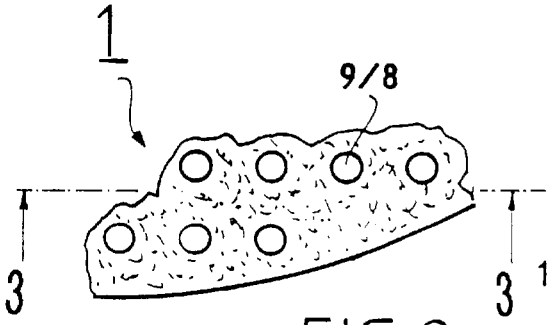
FIG. 2 shows an enlarged detail view of detail "A" in FIG. 1.
Figure 3A:
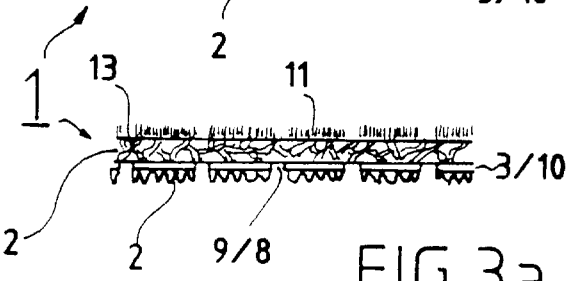
FIG. 3*a* shows a view similar to that of FIG. 2 of another embodiment of a grinding member according to the invention.

According to the invention, the grinding member can have different layer structures. Thus, the grinding member 1, which is shown in FIG. 3*a,* can have in addition to the abrasive-carrying layer 3 or the abrasive-containing layer 10 and the burred connection layer 11, an auxiliary layer 12 formed of a foam material for accommodating and compensation of different space requirements and the like, which can also serve as a temperature insulation layer. It is used in both wet and dry grinding processes. As discussed above, either all of the layers of the grinding member 1 can be pierced with a common perforation or only separate layers can be pierced.

Figure 6:
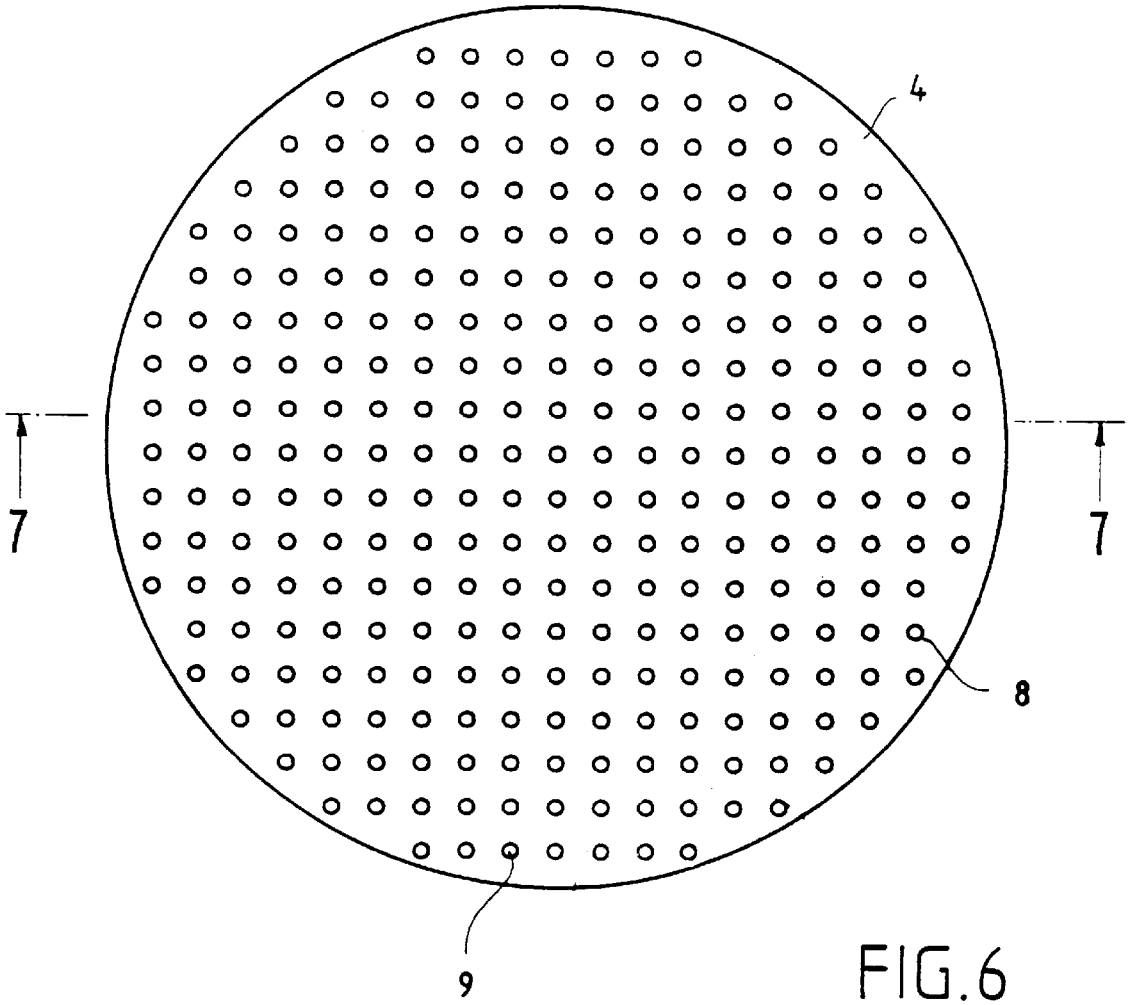
FIG. 6 shows a plan view of a burred connection surface of an adapter according to the present invention.
Figure 7:
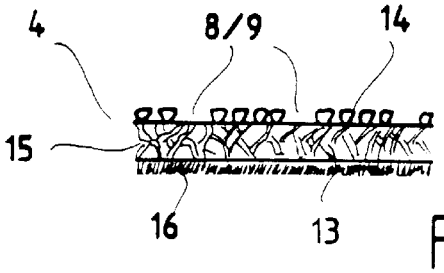
FIG. 7 shows an enlarged partial cross sectional view of the adapter shown in FIG. 6 taken along line 7—7 in FIG. 6.
Figure 8:
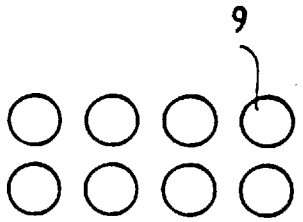
FIGS. 8–16 show different possibilities of forming the perforation.
Figure 9:
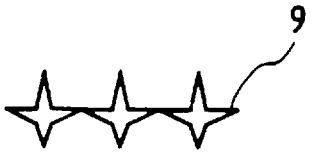
Figure 10:
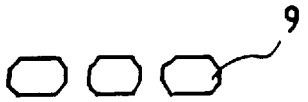
Figure 11:
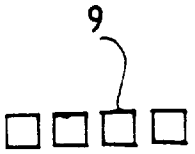
Figure 12:
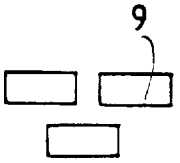
Figure 13:
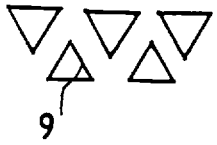
Figure 14:
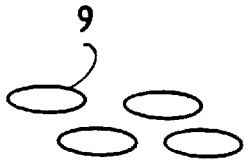

In one of the embodiments of the grinding member according to the present invention, the auxiliary layer 12 is not perforated. In this embodiment, the openings 9 of the perforation 8 provided in the abrasive layer 3/10 are connected with the openings provided in the burred connection layer 11 by channels 13 resulting from the foam structure of the auxiliary layer 12. The channels 13 here insure passing therethrough of both gas and solid particles. The same applies to the adapter which is shown in FIGS. 6 and 7. In the adapter 4, the openings 9 of the perforation 8 pierce the burred connection layer 14. The adapter 4 further includes a foam layer 15 and a velvet layer 16 likewise pierced by the perforation.

FIGS. 8–16 show different shapes of perforation openings 9 formed in the grinding member. The opening 9 shown in FIG. 8 have a circular cross-section. The openings 9 shown in FIG. 9 have a star-shaped cross-section. The openings 9 shown in FIG. 10 have a polygonal cross-section. The openings shown in FIGS. 11–13 have, respectively, a square rectangular and triangular cross-section. The openings shown in FIG. 14 have an oval cross-section.

Figure 15:
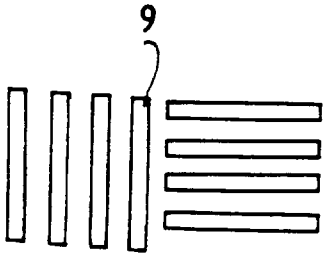
Figure 16:
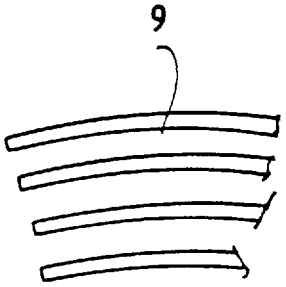

The shape of the openings is generally selected based on the planned use of the grinding member. The opening 9 can have, as shown in FIGS. 15 and 16, respectively a slot or arcuate cross-section. The appropriate perforation is provided in both the grinding member and the adapter. The grinding member and the adapter can be used either together or separately. Thus, the adapter according to the invention can be used with a conventional grinding body provided with conventional openings.

Though the present invention was shown and described with reference to the preferred embodiments, various modifications thereof will be apparent to those skilled in the art and, therefore, it is not intended that the invention be limited to the disclosed embodiments or details thereof, and departure can be made therefrom within the spirit and scope of the appended claims.

What is claimed is:

1. A grinding assembly, comprising:

a support having hole means extending through a thickness of the support and including a gas and particle permeable burred connection layer; and a grinding assembly attachable to the support and comprising at least one abrasive-containing layer having support means formed of a gas and particle impermeable material, and a perforation substantially uniformly distributed over an entire surface of the abrasive-containing layer and extending through an entire thickness of the abrasive-containing layer, and a gas and particle permeable burred connection layer cooperating with the gas and particle permeable burred connection layer on the support for mounting the grinding assembly on the support, the gas and particle permeable burred connection layer of the grinding assembly and the gas and particle permeable connection layer provided on the support insuring, in a mounted condition of the grinding assembly on the support, unhindered auction of abrasive dust accumulating on a working surface of the at least one abrasive-containing layer during operation of the grinding assembly regardless of an arrangement of hole means in the support.

2. A grinding assembly as set forth in claim 1, wherein the gas and particle impermeable material of which the abrasive-containing layer support means is formed is one of paper, cloth and wool.

3. A grinding assembly as set forth in claim 1, wherein each perforation opening has a circular cross-section.

4. A grinding assembly as set forth in claim 1, wherein the perforation extends through both the abrasive-containing and burred connection layers.

5. A grinding assembly as set forth in claim 4, wherein the grinding member further comprises an auxiliary layer located between the abrasive-containing and burred connection layers.

6. A grinding assembly as set forth in claim 5, wherein the auxiliary layer is formed as an elastic layer.

7. A grinding assembly as set forth in claim 5, wherein the auxiliary layer is formed as a temperature insulating layer.

8. A grinding assembly as set forth in claim 1, wherein each perforation opening has a polygonal cross-section.

9. A grinding assembly as set forth in claim 1, wherein each perforation opening has an oval cross-section.

10. A grinding assembly as set forth in claim 1, wherein each perforation opening has a slot-shaped cross-section.

11. A grinding assembly as set forth in claim 10, wherein each slot forming a perforation opening is rectilinear.

12. A grinding assembly as set forth in claim 10, wherein each slot forming a perforation opening is arcuate.

13. A grinding assembly as set forth in claim 1, wherein the grinding member is disc-shaped.

14. A grinding assembly as set forth in claim 1, wherein the grinding member has a circular cross-section.

15. A grinding assembly as set forth in claim 1, wherein the grinding member has a polygonal cross-section.

16. A grinding assembly as set forth in claim 1, wherein the grinding member has a rectangular cross-section.

17. A grinding assembly as set forth in claim 1, wherein the grinding member has a triangular cross-section.

18. A grinding assembly as set forth in claim 1, wherein the grinding member has a star-shaped cross-section.

* * * * *